United States Patent [19]

Geary et al.

[11] Patent Number: 4,699,211

[45] Date of Patent: Oct. 13, 1987

[54] SEGMENTAL BAFFLE HIGH PERFORMANCE SHELL AND TUBE HEAT EXCHANGER

[75] Inventors: David F. Geary, Severna Park; Katherine K. Flamm, Baltimore; Frank T. Morrison, Arnold, all of Md.

[73] Assignee: Baltimore Aircoil Company, Inc., Jessup, Md.

[21] Appl. No.: 879,837

[22] Filed: Jun. 27, 1986

Related U.S. Application Data

[63] Continuation of Ser. No. 470,805, Feb. 28, 1983, abandoned.

[51] Int. Cl.[4] ..... F28D 1/04

[52] U.S. Cl. ..... 165/159; 165/179

[58] Field of Search ..... 165/109, 159, 164, 179

[56] References Cited

U.S. PATENT DOCUMENTS

| | | | |
|---|---|---|---|
| 1,904,875 | 4/1933 | Metzgar | 165/159 |
| 2,693,942 | 11/1954 | Guala | 165/159 |
| 3,612,175 | 10/1971 | Ford et al. | 165/159 |
| 3,630,276 | 12/1971 | Paine et al. | 165/158 |
| 3,739,443 | 6/1973 | Friedman | 165/159 |
| 4,221,261 | 9/1980 | Wunder et al. | 165/159 X |
| 4,305,460 | 12/1981 | Yampolsky | 165/179 |
| 4,412,582 | 11/1983 | Meiozzi et al. | 165/159 X |

FOREIGN PATENT DOCUMENTS

| | | | |
|---|---|---|---|
| 193008 | 12/1906 | Fed. Rep. of Germany | 165/159 |

OTHER PUBLICATIONS

Heat Transfer Engineering, vol. 2, No. 2-Oct.-Dec. '80, pp. 69 through 73, "Evolution of Shell-and-Tube Heat Exchanger Design Practices", by Jerry Taborek.

Industrial and Engineering Chemistry, vol. 41, No. 11, pp. 2499 through 2511, "Heat Transfer and Pressure Drop in Heat Exchangers", by Daniel A. Donohue.

*Primary Examiner*—Albert W. Davis, Jr.
*Assistant Examiner*—Peggy Neils
*Attorney, Agent, or Firm*—Edward J. Brosius; Charles E. Bouton

[57] ABSTRACT

The invention comprises a high performance segmented baffled shell and tube heat exchanger in which baffles are oriented at angles less than 180° adjacent one another.

2 Claims, 3 Drawing Figures

SEGMENTAL BAFFLE HIGH PERFORMANCE SHELL AND TUBE HEAT EXCHANGER

The present application is a continuation of U.S. Ser. No. 470,805, filed Feb. 28, 1983 now abandoned.

BACKGROUND OF THE INVENTION

In the past, several methods were used to obtain better heat transfer coefficients in shell and tube heat exchangers. Briefly, these methods were (1) increasing the flow rate and increasing the pressure drop in typical shell and tube heat exchangers, (2) by increasing the heat transfer surface area in shell and tube heat exchangers, such as by using a fluted tube, or (3) by using a different type of heat exchanger than the shell and tube heat exchanger altogether, such as a plate and frame heat exchanger, which utilizes extremely narrow flow passages to enhance heat transfer. Thus, those skilled in the art continue to look for designs of shell and tube heat exchangers of more compact size which occupy less space and/or which lead to high overall heat transfer coefficients combined with low pressure drops over a broad range of fluid flow rates in the shell and tube heat exchangers.

SUMMARY OF THE INVENTION

The invention relates to a high performance shell and tube heat exchanger and a method of obtaining high overall heat transfer coefficients at low pressure drops and low flow rates in said shell and tube heat exchangers wherein the shell and tube heat exchangers utilize segmented shell-side baffles which are oriented one from the other along the line of tubes in the shell and tube heat exchanger at angles other than 180° and preferably at lesser angles such as about 90°. Further, it has been found that if one uses fluted or corrugated tubes in the shell and tube heat exchanger along with the segmented baffles being spaced adjacent from one another at angles less than 180°, along the direction of flow of the fluid within the shell, overall heat transfer coefficients are improved to a greater extent than one would expect by summing the improvements that are obtained from using (a) fluted tubes with no shell-side baffles plus (b) smooth tubes with non-180° segmental shell-side baffles. This is to say that one expects a given improvement in thermal overall heat transfer coefficient Uo or K when using either (a) or (b) above rather than smooth tubes in a 180° segmentally baffled heat exchanger. However, the unexpected finding is that the given improvement in K when using both (a) and (b) simultaneously is greater than the sum of individual improvements (a) plus (b).

Thus, it is an object of this invention to obtain high overall heat transfer coefficients at low pressure drops and low fluid flows in shell and tube heat exchangers by using a shell and tube heat exchanger having segmented shell-side baffles therein which are oriented at angles less than 180° adjacent each other and along the flow direction of the fluid within the shell of said shell and tube heat exchanger.

It is a further object of this invention to provide a high performance shell and tube heat exchanger which utilizes the segmented baffles and which also has therein fluted tubes for better heat transfer characteristics.

It is a further object of this invention to provide a heat exchanger which eliminates or reduces the amount of tube vibration that may exist due to tube support baffle peripheral clearance tolerances.

To better describe the invention there are included herein FIGS. 1, 2 and 3.

Figures 1, 3:
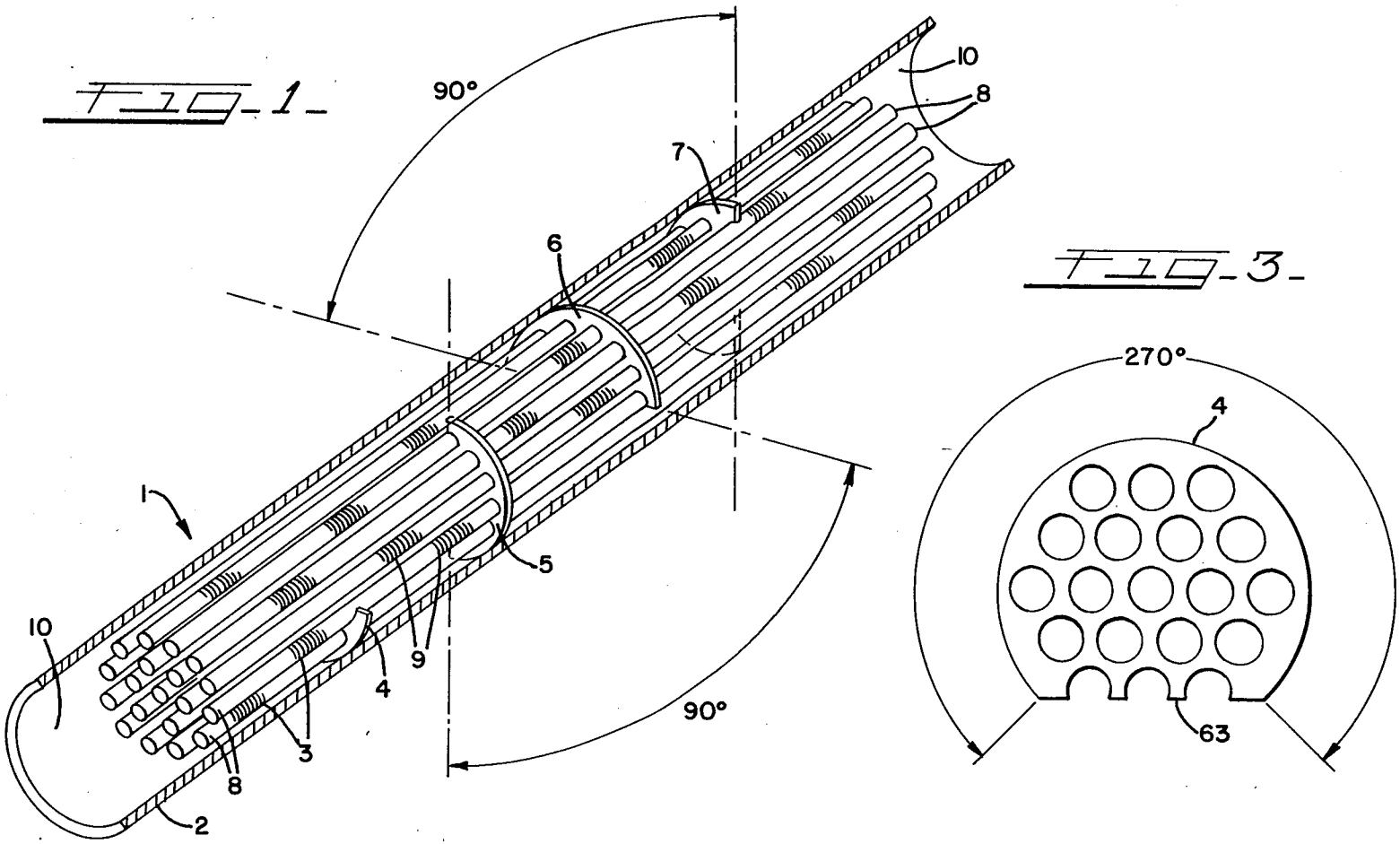
FIG. 1 shows a cutaway view of a typical shell and tube heat exchanger with the segmented baffles therein.
FIG. 3 shows another embodiment of the baffle having a typical 270° segmental baffle arc angle.
Figure 2:
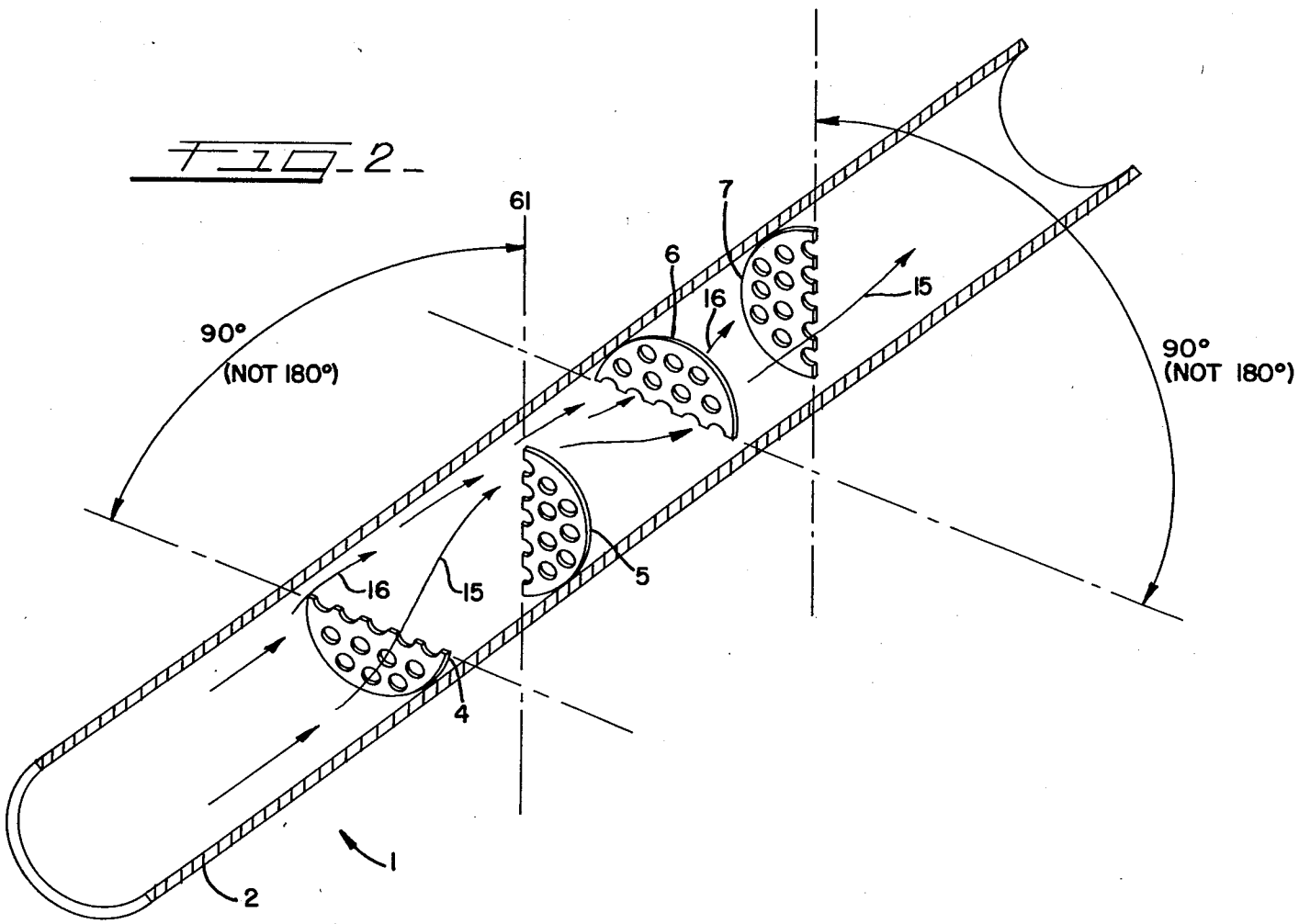
FIG. 2 shows the same cutaway view of the baffles and shell without the individual tubes of the shell and tube heat exchanger.

Referring now to FIGS. 1 and 2, a central portion 1 of a typical shell and tube heat exchanger is shown. Typical flanges for enclosing the shell ends, inlet and outlet piping portions and tube sheets or tube end walls are not shown in the diagram but would be well known to those skilled in the art. This heat exchanger consists of a housing or shell portion 2 shown in cutaway views having therein a plurality of fluted tubes 3. These tubes can be arranged within the heat exchanger in a typical spaced pattern, and the number and size of the tubes will vary depending on the type of heat exchanger one is using. The fluid or material to be cooled is typically, though not necessarily always, within the shell 2 of the heat exchanger 1 flowing in one direction whereas the heat exchange fluid inside of the tubes 3 flows in the opposite direction. Also, the tubes 3 are continuously fluted 9, along substantially the complete tube length, except for each tube end 8, where the tube surface is smooth to permit a proper seal or tube end attachment to a separating tube end wall at the ends of tubes which encloses and seals the outside of all tube ends from the outer shell region 10.

Located within the shell and tube heat exchanger 1 are a plurality of segmented-circular baffles 4, 5, 6, and 7. These baffles are in the form of a circular segment having an arc of from 90° to about 340°, as shown in FIG. 3. These baffles are provided in the heat exchanger 1 such that adjacent baffles are oriented at an angle less than 180° from each other. The baffles are constructed with holes such that they fit snugly over the plurality of tubes 3 provided within the heat exchanger and would prevent the flow of fluid outside the tubes where the baffle is located since the baffle forms a wall against fluid flowing in the direction of the baffle, thereby causing a rotating flow direction or a combination rotating flow with undulating flow pattern.

As can be seen in FIG. 2, the plurality of baffles 4 through 7 are oriented at an angle of 90° from each other in such a way so that fluid flowing within the shell 2 forms a helical spiral configuration (shown as $\beta$15) as it flows along. In addition to forming a helical spiral fluid flow ($\beta$15) a portion of the fluid also flows in a wavelike undulating pattern (shown as $\beta$16), and it is the combination of the wavelike undulating pattern along with the spiral helical flow pattern that brings about the higher heat transfer efficiency of this type of shell and tube heat exchanger.

The baffles can be constructed of any material such as for example metal or other material which preferably is noncorrosive to the fluid flowing therethrough.

Although the angles at which the baffles are oriented one from the other is shown in FIG. 2 as 90°, one skilled in the art would realize that any angle less than 180° from the previous baffle would be satisfactory; although the preferred angle is substantially 90°. The particular 90° angle is shown in FIG. 2 such that if one takes baffle no. 4 with one side of the angle as the diameter line 60 which is an extension of the diameter line of the baffle (9) or chord line 63 of a baffle of the type shown in FIG. 3, and one takes the diameter or chord line of the next adjacent baffle (shown as line 61), it can be seen that the twist angle of difference thereto is 90°. This follows similarly with baffles 5 and 6 where the angle is also 90° taken as an extension of the diameters of the adjacent baffles.

The baffles are spaced apart in the shell and tube heat exchanger at such a distance as to provide a natural spiral helical and wave-like flow path of any fluid therethrough. The baffles must be located a distance apart at least 0.7 times the diameter of the baffle or shell but not greater than 6.0 times the diamter of the shell and cannot be at such a close or extremely far distance so that any spiral and wave-like pattern of fluid flowing therethrough would be difficult to form.

These baffles have an outside diametric clearance to fit within the shell with ease. However, it should be noted that the baffles are not physically attached to the inside wall of the shell, but rather held in position axially by rods (not shown) which parallel the tubes. Therefore, it is conceivable that the baffles can vibrate within the shell due to the clearance tolerances. It is further important to note that segmental baffles at 180° twist positions can vibrate over a greater distance in the direction perpendicular to the straight cut segment side, than in any other direction. Therefore, orienting each second baffle at 90° rather than 180° will prevent vibration in the assembly by means of alternate supporting baffle orientation of the straight edge.

Although in FIG. 3 there is shown a segmental baffle angel of 270°, the baffle angle may logically be varied from about 90° to 340° maximum and still arrive at good heat transfer results depending on relative fluid properties and mass transfer rates.

The above description refers to an illustration of the invention and is not intended to be limitative thereof. For example, the invention includes consideration for any generic type of segmental baffle, such as single, double, triple, or any multiple-segmental baffle component. Those skilled in the art would realize that other embodiments falling within this invention are possible and these embodiments are intended to be claimed by Applicants.

What is claimed is:

1. A shell and tube heat exchanger comprising:

(a) an outer shell;

(b) a plurality of tubes substantially and continuously fluted within said shell;

(c) a series of segmental semicircular baffles forming a partial barrier to liquid flow each having a segmental baffle angle of about 180° with circular holes therethrough for blocking the fluid flow around the tubes passing through said holes, said baffles being spaced axially along and generally perpendicular to said tubes within said outer shell and being oriented such that a twist angle is formed by the diameter line of one baffle and the diameter line of each adjacent baffle in said series of baffles, and that said twist angle between adjacent baffles is about 90° to cause a combination of undulating and rotating helical flow in the shell flow area outside of the tubes.

2. The shell and tube heat exchanger of claim 1 wherein the baffles are circular in form and are located a distance apart of at least 0.7 times the diameter of the baffle but not greater than 6 times the diameter of the baffle.

* * * * *